US005733143A

United States Patent [19]

Ward et al.

[11] Patent Number: 5,733,143

[45] Date of Patent: Mar. 31, 1998

[54] STACKED ELECTRICAL CONNECTOR ASSEMBLY

[75] Inventors: Terrence S. Ward, Cordova; Sharanjit S. Aujla, Collierville, both of Tenn.

[73] Assignee: Thomas & Betts Corporation, Memphis, Tenn.

[21] Appl. No.: 530,800

[22] Filed: Sep. 20, 1995

[51] Int. Cl.[6] ..... H01R 13/60

[52] U.S. Cl. ..... 439/541.5; 439/595; 439/79

[58] Field of Search ..... 439/541.5, 595, 439/744, 603, 79, 80

[56] References Cited

U.S. PATENT DOCUMENTS

| | | | |
|---|---|---|---|
| 3,066,272 | 11/1962 | Quackenbush | 439/595 |
| 3,255,427 | 6/1966 | Yeiser | 439/595 |
| 3,747,047 | 7/1973 | Carter et al. | 439/595 |
| 4,023,880 | 5/1977 | Powell | 439/595 |
| 5,336,109 | 8/1994 | Hillbish et al. | 439/541.5 |

*Primary Examiner*—Gary F. Paumen
*Assistant Examiner*—Tho Dac Ta
*Attorney, Agent, or Firm*—Michael L. Hoelter; Salvatore J. Abbruzzese

[57] ABSTRACT

An upstanding stacked electrical connector assembly comprises an upper connector having a plurality of contact elements, each having a first segment rearwardly therein and a second segment extending downwardly from the first segment, a lower connector having a plurality of contact elements, each having a first segment extending rearwardly therein and a second segment extending downwardly from the first segment, support structure for supporting the upper and lower connectors in vertically spaced relation and having transversely spaced elements extending rearwardly from and vertically below the second connector and contact retention structure disposed between the transversely spaced elements of the support structure for receiving at least the second segments of the contacts of the upper connector and retaining the received contact second segments against both transverse and vertically upward movement relative to the connector assembly.

18 Claims, 2 Drawing Sheets

STACKED ELECTRICAL CONNECTOR ASSEMBLY

FIELD OF THE INVENTION

This invention relates generally to so-called stacked electrical connector assemblies and pertains more particularly to stacked electrical connector assemblies of type having contact tails for insertion into printed circuit boards or other mating structure adapted for receipt of contact tails depending from one or more of the discrete stacked connectors of the assemblies.

BACKGROUND OF THE INVENTION

A known version of a stacked connector assembly, commercially available for at least a decade, is seen in the *HANDBOOK OF D-SUBMINIATURE CONNECTORS MIL-C* 24308 & *MIL-C*39029, of Positronic Industries, Inc. The assembly has an upper connector and a lower connector, having respective right-angle contact elements extending rearwardly and downwardly of the assembly for insertion into a printed circuit board (PCB). Both connector bodies are secured to side brackets and a "locking support member" serves to enhance positioning of the contact elements as the contact elements exit the assembly and enter counterpart holes in the PCB. Other known stacked connector assemblies are shown in various, for example, U.S. Pat. Nos. 4,612,602, 4,818,239, 4,878,856, 5,044,984 and 5,336,109.

Where the downward extents of contact elements of the upper connector of a stacked connector assembly are of short length, or where the contacts are relatively thick and thus self-sustaining in right angle disposition, the prior art may look to direct insertion of the end tails of such contacts in a PCB, as is seemingly shown in FIG. 12 of the '602 patent. On the other hand, where the downward extents of contact elements of the upper connector of a stacked connector assembly are of long length and/or where the contacts are relatively thin and thus not self-sustaining in right angle disposition, the prior art has looked to the locking support member, noted above for the long-standing commercial Positronic stacked connector assembly. Various such locking support members are evidenced in the above-noted patents other than the '602 patent.

A difficulty with various of the above-referenced known stacked connector assemblies, from applicant's viewpoint, resides in the exposure of contact element tails to bending and other deformation in the course of their insertion into the PCB, and potential failure to properly seat in the PCB holes despite the presence of the locking support members. Thus, with the exception of the additive structure shown in the connector assemblies of the '239 and '856 patents, there is no structure at hand which confines the right-angle portions of the contact elements from such bending or other deformation. The locking support members thereof impose only lateral positional retention constraints on the contact tails.

While the prior art approach adopted in the '239 and '856 patents has less susceptibility to such bending and other deformation, it is achieved only at the cost of so-called "pin extension member 16", which serves to electrically extend the contact elements 32 of the upper connector body. The contact pins of the pin extension member are encased in rigid plastic, virtually precluding deformation thereof. Evidently, such solution increases both the cost of the stacked connector assembly in respect of pin contact extensions and encasing plastic. Assembly thereof is also complicated to the extent of requiring steps of inserting the shortened contacts of the upper connector element into the pin extension members. Further, connector electrical performance has concern in respect of the additional connection interface required as between the shortened contacts of the upper connector and the pin extension members.

SUMMARY OF THE INVENTION

The present invention has as its primary object the provision of stacked electrical connector assemblies having enhanced resistance to contact tail bending or deformation.

A more particular object of the invention is to provide stacked electrical connector assemblies which achieve multi-directional contact tail retention without need for structure encasing the contact tails over extended lengths thereof.

In attaining the foregoing and other objects, the invention provides an upstanding stacked electrical connector assembly comprising an upper connector having a plurality of contact elements, each having a first segment rearwardly therein and a second segment extending downwardly from the first segment, a lower connector having a plurality of contact elements, each having a first segment extending rearwardly therein and a second segment extending downwardly from the first segment, support means for supporting the upper and lower connectors in vertically spaced relation and having transversely spaced elements extending rearwardly from and vertically below the second connector and contact retention means disposed between the transversely spaced elements of the support means for receiving at least the second segments of the contacts of the upper connector and retaining the received contact second segments against both transverse and vertically upward movement relative to the connector assembly.

The foregoing and other objects and features of the invention will be further understood from the following detailed discussion of preferred practices and embodiments thereof and from the drawings wherein like reference numerals identify like components and part throughout.

BRIEF DESCRIPTION OF THE DRAWING FIGURES

DETAILED DESCRIPTION OF THE PREFERRED EMBODIMENT(S)

Figure 1:
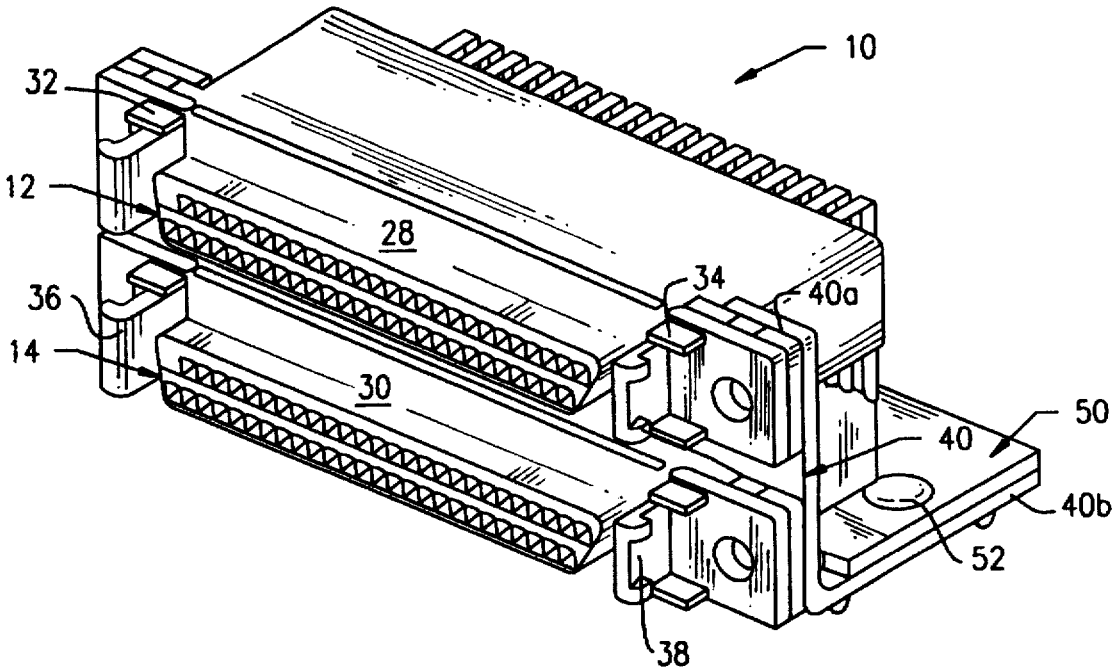
FIG. 1 is a perspective view of a stacked electrical connector assembly in accordance with the invention.
Figure 2:
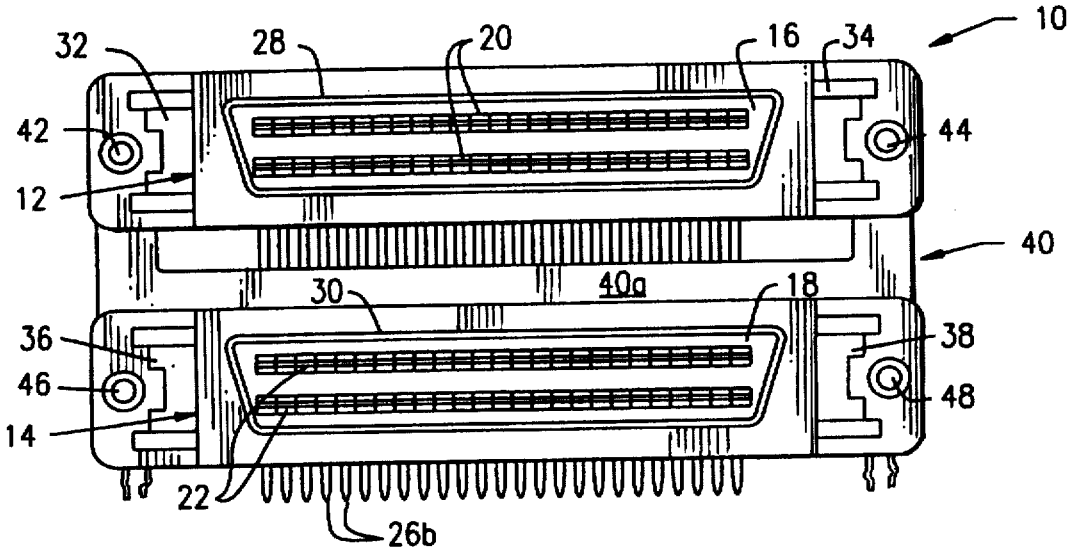
FIG. 2 is a front elevation of the FIG. 1 assembly.
Figure 3:
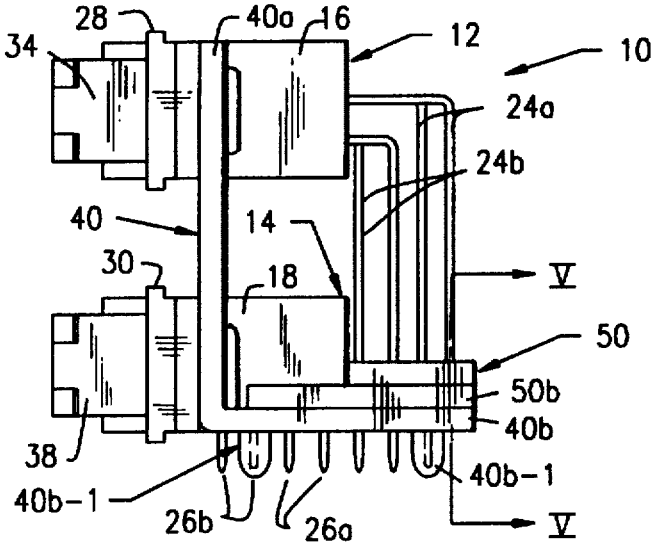
FIG. 3 is a right side elevation of FIG. 2.
Figure 4:
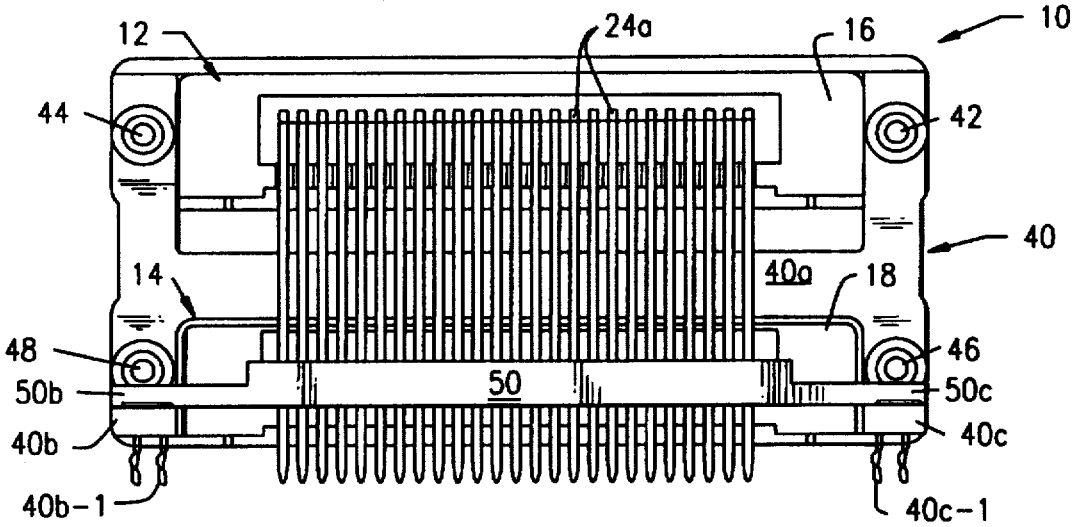
FIG. 4 is a right side elevation of FIG. 3, constituting a rear elevation of FIG. 2.

Referring to FIGS. 1–4, stacked electrical connector assembly 10 includes upper connector 12, lower connector 14, having respective housings 16 and 18 of electrically insulative material. Female to male contact elements 20 and 22 are resident respectively in housings 16 and 18 in respective upper and lower rows. Contacts 20 have right-angle tail portions **24*a* and 24*b* continuous with contacts 20. Contacts 22 have right-angle tail portions 26*a* and 26*b* continuous with contacts 22 and 26*d*** continuous.

Metal shell members 28 and 30 circumscribe forward extents of connectors 12 and 14, respectively, and end blocks 32, 34 and 36, 38 are further associated therewith. A support member in the form of bracket 40 is secured, through a vertical section 40*a* thereof to upper connector 12, by rivets 42 and 44, and, also through vertical section 40*a* to lower connector 14, by rivets 46 and 48. Bracket 40 further includes rearwardly extending, transversely spaced side members 40*b* and 40*c*.

Figure 5:
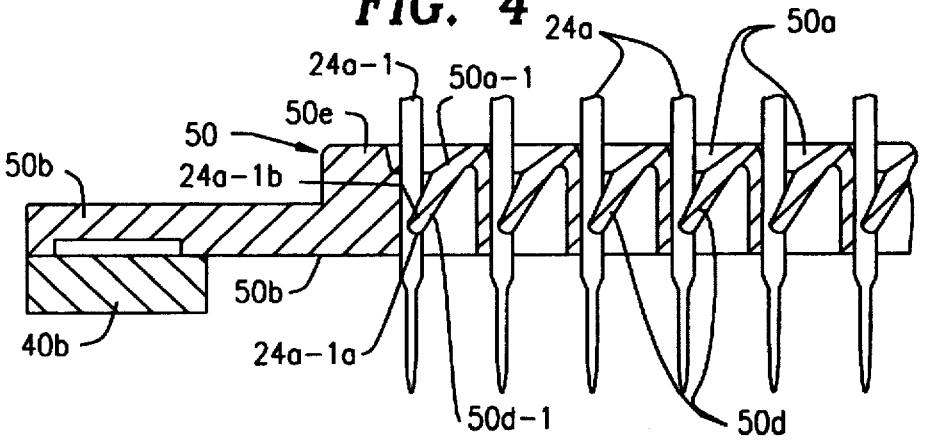
FIG. 5 is a partial sectional view as would be seen from plane V—V of FIG. 3.

Referring now also to FIG. 5, contact retention structure 50 in accordance with the invention has a central portion defining passages 50*a* for contact tails to pass therethrough and outer portions 50*b* and 50*c*. Structure 50 is disposed atop transversely spaced side members 40*b* and 40*c* and is secured thereto by rivets, one being shown at 52 in FIG. 1, extending through apertures in outer portions 50*b* and 50*c*.

Structure 50 is comprised of an electrically insulative member and defines interior deflectable portions 50*d*, each in respective partial bounding relation to a distinct one of passages 50*a*. The insulative member of the contact retention means is elongate and supports the deflectable parts for deflection along the longitudinal axis thereof.

As illustrated for contact 24*a*-1, resident in passage 50*a*-1, it has a tail portion of generally rectangular cross-section in the passage of the insulative member and has a detent defined by a radially interiorly extending notch in the cross-section portion. It should be appreciated that contact cross-sections of other configurations, such as cylindrical or U-shape, could also be used. More particularly, the insulative member has respective upper and lower mutually parallel planar surfaces 50*e* and 50*f*, between which passage 50*a*-1 extends and deflectable part 50*d*-1 is cantilever-supported and disposed at an angle intersecting the planes of upper and lower surfaces 50*e* and 50*f*. The contact 24*a*-1 detent notch is defined by a floor 24*a*-1*a* generally parallel to upper and lower surfaces 50*e* and 50*f* of the insulative member and a wall 24*a*-1*b* extending from floor 24*a*-1*a* at substantially the same angle as the disposition angle of the cantilever-supported part 50*d*-1 of the insulative member.

Other than for the deflectable part 50*d*-1, the insulative member has continuous, undeflectable surface in bounding relation to passage 50*a*-1.

The described cantilever-supported part and the remnant continuous bounding surface of the passages in contact retention structure 50 will be appreciated as achieving the contact tail positioning function of the prior art connector assemblies having contact "locking support structure", above discussed. Significantly, however, structure 50, based on its inclusion of the coaction of the deflectable part further with the contact tail detents, provides the further function of providing resistance to upward displacement of the contacts received in the contact retention structure passages. Thus, as the assembled connector is applied to a PCB, at which time snap latches 40*b*-1 and 40*c*-1 depending from side members 40*b* and 40*c* secure the assembly to the PCB, upward force exerted by the PCB on the contact tails is arrested and absorbed at the detent-deflectable part interface, and is precluded from imparting bending or other deformation to the right-angle segments of the contacts.

By way of summary of the foregoing and introduction to the ensuing claims, the invention will be seen to provide an upstanding stacked electrical connector assembly, comprising an upper connector having a plurality of contact elements, each having a first segment rearwardly therein and a second segment extending downwardly from the first segment, a lower connector having a plurality of contact elements, each having a first segment extending rearwardly therein and a second segment extending downwardly from the first segment, support means for supporting the upper and lower connectors in vertically spaced relation and having transversely spaced elements extending rearwardly from and vertically below the second connector and contact retention means disposed between the transversely spaced elements of the support means for receiving at least the second segments of the contacts of the upper connector and retaining the received contact second segments against both transverse and vertically upward movement relative to the connector assembly.

The contact retention means comprises an electrically insulative member defining passages therethrough for the received contact second segments and a deflectable part in partial bounding relation to each the passage.

The received contact second segments define respective detents and deflectable parts of the contact retention means are resident respectively in the detents.

The insulative member of the contact retention means is elongate and supports the deflectable parts for deflection along the longitudinal axis thereof.

The received contact second segments have portions of generally rectangular cross-section in the passages of the insulative member and the detents of the received contact second segments are defined by radially interiorly extending notches in the cross-section portions.

The insulative member of the contact retention means has respective upper and lower mutually parallel planar surfaces. The passages extend between the upper and lower surfaces and the deflectable parts of the contact retention means comprise cantilever-supported parts of the insulative member disposed at an angle intersecting the planes of the upper and lower surfaces of the insulative member.

The received contact second segments have portions of generally rectangular cross-section in the passages of the insulative member and the detents of the received contact second segments are defined by a floor generally parallel to the upper and lower surfaces of the insulative member and a wall extending from the floor at substantially the same angle as the disposition angle of the cantilever-supported parts of the insulative member.

The contact retention means is disposed vertically above the transversely spaced elements of the support means and is secured thereto.

The support means includes securement elements for securing the connector assembly to a printed circuit board, the securement elements are in downwardly depending relation from the transversely spaced elements of the support means.

As desired, the contact retention means may receiving the second segments of the contacts of the upper and lower connectors and retaining the received contact second segments against both transverse and vertically upward movement relative to the connector assembly.

Different groups of the second segments of the lower and/or upper connector may be located in respective first and second planes successively rearwardly disposed in the assembly, the second planes being rearwardly successive to the first planes.

Various changes to the particularly disclosed stacked connector assemblies and practices may evidently be introduced without departing from the invention. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. A stacked electrical connector assembly, comprising:

(a) an upper connector having a plurality of contact elements, each having a first segment rearwardly therein and a second segment extending downwardly from said first segment;

(b) a lower connector having a plurality of contact elements, each having a first segment extending rearwardly therein and a second segment extending downwardly from said first segment; and (c) support means for supporting said upper and lower connectors in vertically spaced relation and having transversely spaced elements extending rearwardly from and vertically below said lower connector; the support means further including a contact retention plate disposed between said transversely spaced elements of said support means, the contact retention plate having a plurality of contact receiving passages for receiving at least said second segments of said contacts of each of said upper and lower connectors and wherein each of the contact receiving passages includes a cantilevered deflectable portion for locking engagement with said second segments of said contacts thereby aligning and retaining the received contact second segments against both transverse and vertically upward movements relative to said connector assembly.

2. The stacked electrical connector assembly claimed in claim 1, wherein said contact retention plate comprises an electrically insulative member.

3. The stacked electrical connector assembly claimed in claim 1, wherein said contact retention plate is disposed vertically above said transversely spaced elements of said support means and is secured thereto.

4. The stacked connector assembly claimed in claim 1, wherein some of said plurality of contact second segments of said lower connector are located in respective first planes successively rearwardly disposed in said assembly and wherein some of said plurality of contact second segments of said upper connector are located in respective second planes successively rearwardly disposed in said assembly, said second planes being rearwardly successive to said first planes.

5. The stacked electrical connector assembly claimed in claim 1, wherein the received contact second segments define respective detents and wherein the deflectable portions of said contact retention plate are lockingly engaged in said detents.

6. The stacked electrical connector assembly claimed in claim 5, wherein said insulative member of said contact retention means is elongate and supports said deflectable portions for deflection along a longitudinal axis thereof.

7. The stacked electrical connector assembly claimed in claim 6, wherein the received contact second segments have portions of generally rectangular cross-section in said passages of said insulative member and wherein said detents of the received contact second segments are defined by radially interiorly extending notches in said cross-section portions.

8. The stacked electrical connector assembly claimed in claim 6, wherein said insulative member of said contact retention plate has respective upper and lower mutually parallel planar surfaces, wherein said passages extend between said upper and lower surfaces and wherein said deflectable portions of said contact retention plate are disposed at an angle intersecting the mutually parallel planar surfaces of said insulative member.

9. The stacked electrical connector assembly claimed in claim 8, wherein the received contact second segments have portions of generally rectangular cross-section in said passages of said insulative member and wherein said detents of the received contact second segments are defined by a floor generally parallel to said upper and lower surfaces of said insulative member and a wall extending from said floor at substantially the same angle as the disposition angle of said cantilever-supported deflectable portions of said insulative member.

10. The stacked electrical connector assembly claimed in claim 1, wherein said support means includes securement elements for securing said connector assembly to a printed circuit board.

11. The stacked electrical connector assembly claimed in claim 10, wherein said securement elements are in downwardly depending relation from said transversely spaced elements of said support means.

12. A stacked electrical connector assembly, comprising:

(a) an upper connector having a plurality of contact elements, each having a first segment rearwardly therein and a second segment extending downwardly from said first segment, the second segment of each contact element including a detent formed therein;

(b) a lower connector having a plurality of contact elements, each having a first segment extending rearwardly therein and a second segment extending downwardly from said first segment, the second segment of each contact element including a detent formed therein; and (c) a bracket for supporting said upper and lower connectors in vertically spaced relation, the bracket including a contact retention plate, the contact retention plate including a plurality of passageways for receiving said second segments of said contacts of said upper and lower connector and wherein each of the contact receiving passageways includes a cantilevered deflectable locking tab for locking engagement with the detents of the second contact segments of the upper and lower connectors for aligning and retaining the received contact second segments against both transverse and vertically upward movements relative to said connector assembly.

13. The stacked electrical connector assembly claimed in claim 12, wherein said support means includes securement elements for securing said connector assembly to a printed circuit board.

14. The stacked electrical connector assembly claimed in claim 12, wherein said contact retention plate comprises an electrically insulative member.

15. The stacked electrical connector assembly claimed in claim 14, wherein said insulative member of said contact retention plate is elongate and supports said deflectable locking tabs for deflection along a longitudinal axis thereof.

16. The stacked electrical connector assembly claimed in claim 15, wherein the received contact second segments have portions of generally rectangular cross-section in said passages of said insulative member and wherein said detents of the received contact second segments are defined by radially interiorly extending notches in said cross-section portions.

17. The stacked electrical connector assembly claimed in claim 15, wherein said insulative member of said contact retention plate has respective upper and lower mutually parallel planar surfaces, wherein said passages extend between said upper and lower surfaces and wherein said deflectable locking tabs of said contact retention plate are disposed at an angle intersecting the mutually parallel planar surfaces of said insulative member.

18. The stacked electrical connector assembly claimed in claim 17, wherein the received contact second segments have portion of generally rectangular cross-section in said passages of said insulative member and wherein said detents of the received contact second segments are defined by a floor generally parallel to said upper and lower surfaces of said insulative member and a wall extending from said floor at substantially the same angle as the disposition angle of said cantilever-supported locking tabs of said insulative member.

* * * * *